US008557754B2

(12) United States Patent
Singh et al.

(10) Patent No.: US 8,557,754 B2
(45) Date of Patent: Oct. 15, 2013

(54) COMPOSITION OF BIODEGRADABLE GEAR OIL

(75) Inventors: Arun Kumar Singh, Uttarakhand (IN); Aruna Chamoli, Uttarakhand (IN)

(73) Assignee: Counsel of Scientific & Industrial Research, New Delhi (IN)

( * ) Notice: Subject to any disclaimer, the term of this patent is extended or adjusted under 35 U.S.C. 154(b) by 276 days.

(21) Appl. No.: 12/922,874

(22) PCT Filed: Mar. 5, 2009

(86) PCT No.: PCT/IN2009/000150

§ 371 (c)(1), (2), (4) Date: May 6, 2011

(87) PCT Pub. No.: WO2009/116082

PCT Pub. Date: Sep. 24, 2009

(65) Prior Publication Data

US 2011/0207638 A1 Aug. 25, 2011

(30) Foreign Application Priority Data

Mar. 17, 2008 (IN) ..... 670/DEL/2008

(51) Int. Cl.
*C10M 105/34* (2006.01)
*C10M 169/04* (2006.01)

(52) U.S. Cl.
USPC ..... 508/463; 508/282; 508/584; 508/563

(58) Field of Classification Search
USPC ..... 508/282, 491, 463, 563
See application file for complete search history.

(56) References Cited

U.S. PATENT DOCUMENTS

| | | | | |
|---|---|---|---|---|
| 4,082,680 | A | 4/1978 | Mitacek | |
| 4,164,475 | A | 8/1979 | Schieman | |
| 5,358,650 | A | 10/1994 | Srinivasan et al. | |
| 5,364,994 | A | 11/1994 | Scharf | |
| 5,571,445 | A | 11/1996 | Srinivasan et al. | |
| 5,652,201 | A * | 7/1997 | Papay et al. | 508/228 |
| 5,942,470 | A | 8/1999 | Norman et al. | |
| 6,649,574 | B2 | 11/2003 | Cardis et al. | |
| 6,872,693 | B2 | 3/2005 | Cain | |
| 2002/0017629 | A1 * | 2/2002 | Mosier et al. | 252/71 |
| 2005/0277557 | A1 | 12/2005 | Czerwinski et al. | |
| 2007/0060486 | A1 | 3/2007 | Singh et al. | |
| 2007/0135318 | A1 * | 6/2007 | Singh et al. | 508/485 |

FOREIGN PATENT DOCUMENTS

| | | |
|---|---|---|
| DE | 20305164 | 10/2003 |
| IN | 363/DEL/2004 | 3/2004 |
| IN | 779/DEL/2006 | 12/2006 |
| IN | 785/DEL/2006 | 12/2006 |
| IN | 215707 | 3/2008 |
| IN | 215826 | 3/2008 |

OTHER PUBLICATIONS

Erhan, et al., "Lubricant basestocks from vegetable oils", Industrial Crops and Products (2000), pp. 277-282, vol. 11.
Wagner, et al., "Lubricant base fluids based on renewable raw materials Their catalytic manufacture and modification", Applied Catalysis A: General (2001), pp. 429-442, vol. 221.
Schuchardt, et al., "Transesterification of Vegetable Oils: a Review", J. Braz. Chem. Soc. (1998), pp. 199-210, vol. 9, No. 1.
Jain, et al., "Evaluation of thermo-oxidative characteristics of gear oils by different techniques: Effect of antioxidant chemistry", Thermochimica Acta (2005), pp. 172-175, vol. 435.

* cited by examiner

*Primary Examiner* — Jim Goloboy
(74) *Attorney, Agent, or Firm* — White & Case LLP

(57) ABSTRACT

A composition of biodegradable gear oil that mainly contains modified nontauedible vegetable oils. Mono-esters are hydrogenated, epoxidized or aryl alkylated or mixture thereof, and C7 to C12 primary alcohol. In addition to chemically modified non-edible vegetable oils, the composition also contains an additive pack, which comprises at least one: antioxidant, an extreme pressure additive, an anti foaming agent, a pour point depressant, a corrosion inhibitor and a detergent-dispersant additive. The product of this invention has utility as industrial and automotive gear oil GL 4 grade. The compositions are significantly biodegradable, eco-friendly, reduce use of petroleum, have lower cost than synthetic oil, are miscible in mineral & synthetic fluids and safe to use due to higher flash point.

9 Claims, No Drawings

COMPOSITION OF BIODEGRADABLE GEAR OIL

FIELD OF THE INVENTION

The present invention relates to a composition of biodegradable gear oil. This invention particularly relates to composition of biodegradable gear oil that mainly contains chemically-modified non-edible vegetable oils. In addition to chemically modified non-edible vegetable oils, the synergistic composition also contains an additive pack that consists of at least an antioxidant, an extreme pressure additive, an anti-foaming agent, a pour point depressant, a corrosion inhibitor and a detergent-dispersant additive, and has utility as GL4 gear oil for industrial and automotive application.

BACKGROUND OF THE INVENTION

It is not possible to prevent lubricant losses to the environment. Ecological balance is of great concern or survival of living beings. Industrial experts estimate that 70% to 80% of lube oil leaves the system through leaks, spills, line breakage and fitting failure. No doubt, petroleum based lubricants increase the capacity and speed of industry and other machines. It however, leads to increase the toxicity of the environment. It is affecting living organisms including plants, animals and marine life for many years. The petroleum based lubricating oils are hydrocarbons consisting of naphthenes, paraffins, aromatics, polynuclear aromatics and unsaturates. Petroleum based lube-oils, generally suffer from many disadvantages such as high toxicity to the environment, poor biodegradability and inconsistent characteristics with change in crude oil composition. The other types of lubricants known as synthetic lubricants are designed for use in extreme conditions of temperature, pressure, radiation or chemical and have excellent lubricity and thermal stability. The synthetic lubricants are relatively costly, may also be toxic to environment.

Gears transmitted rotary motion. Modern metallurgy has greatly increased the useful life of industrial and automotive gears. Gear oils are used to protect the gears and reduce the friction. Gear oils are classified by the American Petroleum Institute using GL ratings, e.g. GL4 or GL5 oil. API viscosity ratings for latest gear oils are 75W90; or 10W40 or multi-grade. Great efforts have been made during the last 25 years by several countries and major industries to develop and find more and more environment friendly—nontoxic products and technologies which have a less negative impact on environment. So, the past development of gear oils may be summarized as:

- The use of stable mineral base oil for required performance.
- The use of paraffinic mineral base oil to reduce toxicity.
- Use of synthetic base oil such as silicone oil, sulfurized oil, polymers, polybutenes, dibasic acid esters, fluoropolymers, polyol esters, phosphate esters, poly-alpha olefins, etc. to reduce toxicity and enhance lubricant life. Fully synthetic gear oils have a greater resistance to shear breakdown than mineral oils but they are not economical.
- Development of more efficient gear oil additives for better performance.
- Use of biodegradable polyol—fatty acid—esters and mineral oil/synthetic oil blend to increase eco-friendliness.

So, fully biodegradable gear oil from renewable source (vegetable oil) is not developed. In the eco-sensitive area application of biodegradable lube oil is required. Till now most of eco-friendly type gear oils are either biodegradable/non-toxic with poor performance or they have good performance but lack the desired eco-friendliness. Thus, there is a need for a gear oil composition that has both high performances and complete biodegradability.

Certain types of mono-esters from non-edible vegetable oils are useful to reduce pollution, completely biodegradable; these are compatible to mineral oil, and capable of providing the desirable lubricant properties such as good boundary lubrication, high viscosity index, high flash point and low volatility but show poor oxidation stability. Low thermo-oxidative stability of vegetable oils can be improved by suitable chemical modification and additives. Converting vegetable oils (tri-ester) into mono-ester to gain stability is well known chemical modification. The stability can be further improved by partial hydrogenation, epoxidization or alkylation with aromatics.

Vegetable oil that is long chain fatty acid triester of glycerol possesses most of the desirable lubricant properties such as high viscosity index, high flash point, low volatility and good boundary lubrication. As per fatty acid typical composition of vegetable oils, it contains unsaturated acids such as oleic C 18:1 as a major component. It is understood that some of the carbon chain lengths of the carboxylic acids and/or esters discussed here by average carbon numbers. This reflects the fact that some of the carboxylic acids and/or esters are derived from naturally occurring materials and therefore contain a mixture of compounds the major component of which is the stated compound. Non-edible vegetable oil, which are found in abundance in India are, (1) Neem—Mellia Azadirachta in the family Meliaceae, (2) Karanja—*Pongamia glabra* in the family Leguminaceae, (3) Ricebran—*Oryza sativa* in the family Graminaceae, (4) Mahua—*Madhuca Indica* & *Madhuca Longifolia*, (5) Castor—*Ricinus communis* in the family Euphorbiaceae (spurge), (6) Linseed—Flax oil plant *Linium usitatissimum* (Linacae), (7) Other similar vegetable oil or their mixture.

Extensive works were done in the field of development of biodegradable lube base stock and load bearing additive at Indian Institute of Petroleum (CSIR). Several patent applications were filed. The present work is in the continuation of "Biodegradable Lubricants" speciality product from non-edible vegetable oils". Patent applications are:

- A process for the preparation of Phospho sulfurized derivatives or hydrogenated cardanol useful as antiwear, anti-friction extreme pressure additives; O. N. Anand, et. al. IPA (Indian Patent Application) 2522/DEL/98 Dated 28 Aug. 1998, now Indian Patent No. 215707. Assignee—IIP/CSIR
- A formulation useful as an extreme pressure antiwear & antifriction additive for industrial gear oils; O. N. Anand, et. al. IPA 2521/DEL/98 Dated 26 Aug. 1998, now Indian Patent No. 215826. Assignee—IIP/CSIR
- A Process for the Prep. of ecofriendly Lubricants from vegetable oils, O N Anand, et. al; IPA 363/DEL/2004; 5 Mar. 2004, pending; Assignee—IIP/CSIR
- Biodegradable lube for two stroke Gasoline Engine—A. K. Singh, et. al.,—IPA 779/DEL/2006, pending. Assignee—IIP/CSIR
- Biodegradable hydraulic fluid—A. K. Singh, et. al. IPA 785/DEL/2006, pending. Assignee—IIP/CSIR A method for preparing the highly stable mono ester from vegetable oil was developed during the above works. Typical method is: the vegetable oil was dissolved in solvent and kept at low temperature. Filtered to remove gummy material and solvent was distilled off to get de-gummed oil. This oil is partially hydrogenated in a high pressure reactor having hydrogen and Raney Nickel as catalyst until low Iodine value was obtained. Then, primary alcohol C7-C12, partially hydrogenated vegetable oil and catalyst were added in a reactor for esterification. The reaction mixture was refluxed. The catalyst and glycerol were removed. Excess alcohol was removed by distillation under vacuum. Partially hydrogenated mono-ester is treated with per acid. Per acid is added drop wise to ester between 20-30° C. The addition is completed in 10-20 hours. The product is extracted by ether and washed repeatedly with water to remove acid and ether was distilled-off. The remaining ester is washed with hot water to pH 5-7. Partially hydrogenated epoxidized mono-ester was alkylated with alkyl aromatics under Friedel Kraft's reaction conditions. References may be made to:

O N Anand & M Pal, IIP Report, 'Development of Ecofriendly Biodegradable Lubricants/Base stock', August, 2002.

H. Wagner, R. Luther & T. Mang, Lubricant base fluids based on renewable raw materials: their catalytic manufacture and modification, Applied Catalysis A::General 221(2001)429-442.

S. Z. Erhan & S. Asadauskas, Lubricant base stock from vegetable oils, Ind. Crops and products, 11 (2000)277-282.

U. Schuchardt, R. Sercheli & R. M. Vargas, Transesterification of vegetable oils: a review, J. Braz. Chem. Soc., vol 9, no 1, 199-210, 1998.

Reference may be made to U.S. Pat. No. 6,872,693 dated Mar. 29, 2005 by Cain, Assignee; The Lubrizol Corporation (Wickliffe, Ohio)—Mineral gear oils and transmission fluids. This invention relates to mineral oil based gear oils and transmission fluids which comprise a major amount of a mineral oil having an iodine number of less than 9 and where at least 55% of the saturates are aliphatic, and gear oil or transmission fluid additives. In one embodiment, the invention relates to a gear oil or transmission fluid composition comprising a major amount of lubricant basestock and at least one functional additive wherein a major amount of the lubricant basestock comprises a mineral oil having an iodine number of less than 9 and comprising at least 45% by weight of aliphatic saturates. These gear oils and transmission fluids have good viscosity and oxidation properties (Here, mineral oil are used non-biodegradable and non-renewable).

Reference may be made to U.S. Pat. No. 4,082,680 Dated Apr. 4, 1978 by Mitacek; Bill, assignee Phillips Petroleum Company (Bartlesville, Okla.)—Gear oil Composition. Shear-stable, high viscosity index gear oil formulations are formed by the inclusion into such formulations of a small amount of a hydrogenated butadiene-styrene copolymer having a butadiene content of 30 to 44 weight percent and a weight average molecular weight in the range of about 12,000 to about 20,000. (Here, blend of mineral oil and polybutadine are used, non-biodegradable and non-renewable).

Reference may be made to U.S. Pat. No. 4,164,475 dated August 14, 19 by Schieman; Richard D, assignee: The Standard Oil Company (Cleveland, Ohio)—Multi-grade 80W-140 gear oil. A multi-grade 80W-140 gear oil is described which is composed of certain mineral-oil stocks, a wear additive, a V.I. improver, a dispersant polymer and optionally a seal-swell agent 1. In a multi-grade gear oil composition comprising a major proportion of mineral lubricating oil, 5-6 volume percent sulfur- and phosphorous-containing wear additive, 16.6-18.6 volume percent V.I. improver, and 0-2.7 volume percent seal-swell agent, the improvement comprising using as the oil a petroleum-oil stock composed of 20-23 volume percent of a 5.0 centistokes at 210.degree. F. oil, 24-25 volume percent 14.0 centistokes at 210.degree. F. oil, and 26-30 volume percent 25.0 centistokes at 210.degree. F. oil, and from 0.1 to 1.5 volume percent of a dispersant polymer which is an alkyl methacrylate copolymer which has been grafted with a dialkyl amino methacrylate monomer. (Here, mineral oil is used, non-biodegradable and non-renewable).

Reference may be made to U.S. Pat. No. 5,358,650 dated Oct. 25, 1994 Srinivasan; Sanjay and Hartley; Rolfe J. Assignee: Ethyl Corporation (Richmond, Va.) Gear oil compositions. A "cold-clash" gear problem associated with vehicular manual transmissions exposed to the cold is overcome by use of a special all-synthetic gear oil composition. The composition is composed of base oil and specified additive components. The base oil is a blend of di-(2-ethylhexyl) sebacate and three hydrogenated poly-.alpha.-olefin oligomers having kinematic viscosities at 100.degree. C. of about 40, about 8 cst and about 2 cst in specified proportions. The additive components comprise an organic sulfur-containing antiwear and/or extreme pressure agent, an organic phosphorus-containing antiwear and/or extreme pressure agent, a copper corrosion inhibitor, a rust inhibitor, a foam inhibitor, and an ashless dispersant. The gear oil has a boron content of about 0.0025 to about 0.07 wt %. (Here, blend of sebacate and PAO synthetic oil are used, less-biodegradable, a portion is non-renewable, higher cost).

Reference may be made to U.S. Pat. No. 5,571,445 dated Nov. 5, 1996; by Srinivasan, et al. Assignee: Ethyl Corporation (Richmond, Va.)—Gear oil compositions, A "cold-clash" gear problem associated with vehicular manual transmissions exposed to the cold is overcome by use of a special all-synthetic gear oil composition. The composition is composed of base oil and specified additive components. The base oil is a blend of dialkyl ester of an aliphatic dicarboxylic acid having a maximum pour point of about −55.degree. C. and a maximum kinematic viscosity at 100.degree. C. of about 4 cst, and three hydrogenated poly-.alpha.-olefin oligomers having kinematic viscosities at 100.degree. C. of about 40, about 4-8 cst and about 2 cst in specified proportions. The additive components comprise an organic sulfur-containing antiwear and/or extreme pressure agent, an organic phosphorus-containing antiwear and/or extreme pressure agent, a copper corrosion inhibitor, a rust inhibitor, a foam inhibitor, and an ashless dispersant. The gear oil has a boron content of about 0.0025 to about 0.07 wt % (here blend of dialkyl ester and PAO base stocks were used, less-biodegradable, a portion is non-renewable, higher cost.)

Reference may be made to U.S. Pat. No. 5,364,994 dated Nov. 15, 1994 by Scharf; Curtis R, Assignee: The Lubrizol Corporation (Wickliffe, Ohio)—Lubricating compositions containing .alpha.-olefin polymers. The invention deals with viscosity improvers which are .alpha.-olefin polymers and are particularly useful in lubricating compositions comprising (A) a liquid .alpha.-olefin polymer having a number average molecular weight from about 2,000 to about 100,000 and having derived from .alpha.-olefins having from about 4 to about 30 carbon atoms, provided further that (A) has a bimodal molecular weight distribution having (i) a peak molecular weight maximum at 2,000 to 5,000 for a lower molecular weight component and (ii) a peak molecular weight maximum at 50,000 to 75,000 for a higher molecular weight component; (B) an oil of lubricating viscosity land (C) at least one member selected from the group consisting of a friction modifier, a sulfurized olefin, an ash-producing detergent and, an ashless dispersant. (Here, synthetic oil is used, less-biodegradable, higher cost and a portion is non-renewable).

Reference may be made to U.S. Pat. No. 5,942,470 dated Aug. 24, 1999 by Norman, et al. Assignee: Ethyl Petroleum Additives, Inc. (Richmond, Va.)—Lubricant compositions. Gear oils and gear oil additive concentrates of enhanced positraction performance are described. They comprise: (i) at least one oil-soluble sulfur-containing extreme pressure or antiwear agent; (ii) at least one oil-soluble amine salt of a partial ester of an acid of phosphorus; and (iii) at least one oil-soluble succinimide where R.sub.1 is an alkyl or alkenyl group having an average of 8 to 50 carbon atoms, and each of R.sub.2, R.sub.3 and R.sub.4 is a hydrogen atom or an alkyl or alkenyl group having an average of up to about 4 carbon atoms. These compositions preferably contain one, more preferably two, and most preferably all three of the following additional components: (iv) at least one amine salt of a carboxylic acid; (v) at least one nitrogen-containing ashless dispersant; and (vi) at least one trihydrocarbyl ester of a pentavalent acid of phosphorus (Here, synthetic oil are used less-biodegradable, higher cost and a portion is non-renewable).

Reference may be made to U.S. Pat. No. 6,649,574 dated Nov. 18, 2003 by Cardis, et al. Assignee: ExxonMobil Research and Engineering Company (Annandale, N.J.)—Biodegradable non-toxic gear oil A biodegradable lubricating oil composition especially useful as a gear oil employs a synthetic alcohol ester base-stock formed from mono- and dipentaerythritol with certain mono- and dicarboxylic acids or dicarboxylic acid anhydrides and an effective amount of a polyoxyalkylene alcohol demulsifying agent, a combination of alkylated organic acid and ashless succinimide rust inhibitors and an ashless dithiocarbamate antiwear and extreme pressure agent (Here, synthetic oil are used having higher cost).

In the prior art for producing gear oils, generally, mineral oils or blend of mineral oil with synthetic fluids or complex ester of fatty acids were used. The focus has been on the use of such simple mono-ester of non-edible vegetable oil for gear oil, which enhances the performance and biodegradability.

In view of the growing concern about the environment, there is a need for biodegradable gear oils, which are derived from renewable resources, reduce pollution, readily miscible with mineral oil and synthetics. These objectives must be met, while (simultaneously satisfying stringent performance standards.

OBJECTIVES OF THE INVENTION

The main object of the present invention is to provide a composition of biodegradable gear oil based on mono-esters of non-edible renewable vegetable oils such as Neem, Karanja, Rice bran, Mahua, Castor, Linseed and other similar oils.

Yet another object of the present invention is to provide excellent miscibility of formulated gear oil with mineral and synthetic oil in all proportions.

Yet another object of the present invention is to provide formulated gear oil, which satisfies stringent performance standards.

SUMMARY OF THE INVENTION

Accordingly the present invention provides a composition of biodegradable gear oil comprising i. base oil stock containing mono-ester of non-edible vegetable oil or mixture thereof, in the range of 95.5-99.5% by weight, ii. additive pack in the range of 0.5-4.5% by weight, and the said additive is comprising of:

a. at least one anti-oxidant from phenol, amines, gallate, tetrazole, anisole type of compound, in the range of 6.5-12.0% by weight, b. at least one extreme pressure additive selected from the group consisting of sulfide, selenide, phosphosulfide, phosphoselenide in the range of 68.0-23.5% by weight, c. at least one pour point dispersant cum anti-foaming agent selected from the group consisting of polymeric long chain acrylate, alcohol, ester, ether, adipate type compounds in the range of 2.0-46.5% by weight, d. at least one corrosion inhibitor selected from the group consisting of triazole, gallate, polyols, amines, phenols and sulfonates in the range of 11.0-7.0% by weight and e. at least one detergent-dispersant selected from the group consisting of sulfonate, succinimides, phosphonates in the range of 11.0-12.0% by weight.

In an embodiment of the present invention the composition of biodegradable gear oil has following characteristics:

I. Kinematic viscosity at 40° C. is in the range of 50-82 cst,

II. Viscosity index is between 200-270,

III. Oxidation stability is Pass (IP 48/97) (max 1% increase; in viscosity & TAN).

IV. Rotary bomb oxidation test at 95° C. is between 150-200 min.

V. Flash point is between 210-240° C.,

VI. Pour point is between (−)9 to (−)25° C.,

VII. Ash sulfated % is <0.05,

VIII. Copper Strip corrosion test—1 A,

IX. Foam test ASTM D130—Pass,

X. Emulsion test—less than 40-39-1(20)

XI. Lubricity—Friction coefficient—0.105-0.115,

XII. Lubricity—wear scar diameter (mm)—0.303-0.305

XIII. Panel cocking test (deposit, 20 mg max)—Pass

XIV. Biodegradability is between 90-100%.

In yet another embodiment the mono-ester of non edible vegetable oil fatty acid used is selected from the group consisting of hydrogenated fatty acid, C-8 alcohol ester, epoxy ester, aryl alkyl ester and a mixture thereof.

In yet another embodiment the mono-ester of non edible vegetable oil used is selected from the group consisting of toluene derivative of epoxy ester of neem oil fatty acid, xylene alkylated epoxy ester of rice bran oil, toluene ester of mahua oil, toluene ester of rice bran oil, cumene or tetralin ester of non edible vegetable oil and a mixture thereof.

In yet another embodiment the mono-ester of non edible vegetable oil used are obtained from C6 to C16, preferably C7 to C10 primary alcohol and fatty acids of at least one of the non-edible vegetable oil triglyceride fatty acid such as C18:1, C18:2, C18:3, selected from the group consisting of karanja (*Pongamia Glabra*) oil, neem (*Mellia Azadirachta*) oil, rice-bran (*Oryza Sativa*) oil, mahua (*Madhuca Indica*) oil, castor (*Ricinus Communis*) oil, acetylated castor, linseed (Flax-*Linium Usitatissimum*) oils and mixture thereof.

In yet another embodiment the mono-ester of non edible vegetable oil base stock has viscosity, cst, ranging between 50-82, at 40° C.

In yet another embodiment the anti-oxidant used is selected from the group consisting of 2,4,6-tri-tert-butylphenol, 2,6-di-tert-butyl-4-n-butylphenol, 2,6-di-t-butyl-4-methylphenol, dinaphthyl amines, 4-methyl-2,6-di-(t-butyl) phenol, propyl gallate, alkylated 5-amino tetrazole, di-ter. Butyl p-amino phenol, α-tocopherol, butylated hydroxy anisole and a mixture thereof.

In yet another embodiment the extreme pressure additive used is selected from the group consisting of sulfurized neem oil, sulfurized mahua oil, dibenzyl disulphide, suphurized hydrogenated cardanol, thiophosphoro lauryl oleate, molybdenum salt of thiophosphoro lauryl oleate, zinc dialkyl dithio phosphate, dibenzyl diselenate, selenophosphoro lauryl oleate, selenophosphoro hydrogenated cardanol, molybdenum thiophosphoro hydrogenated cardanol and a mixture thereof.

In yet another embodiment the anti-foaming agent cum pour point depressants used is selected from the group consisting of silicone oil, polyvinyl alcohol, polyethers, diethylhexyl adipate, polymethacrylate, polyvinylacrylate and mixture thereof.

In yet another embodiment the anti-corrosion additive used is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated cardanol, magnesium alkyl benzene sulfonates and a mixture thereof.

In yet another embodiment the detergent-dispersant used is selected from the group consisting of amino alkyl benzene sulfonate, calcium alkyl benzene sulfonate, sodium alkyl benzene sulfonate, propylene tetramer succinimide of pentaethylene hexamine, octyl phosphorates and mixture thereof.

In yet another embodiment the composition of biodegradable gear oil is useful for GL 4 grade, general purpose automotive and industrial gear oil.

The compositions of the present invention are significantly biodegradable, exhibit excellent miscibility with mineral and synthetic oil in all proportions. The main advantages of the present invention are following; reduces use of petroleum, beneficial to farmers, and safer to handle due to higher flash point of 200-240° C. The present lubricant would be particularly suited for GL 4 grade, general purpose automotive and industrial gear oil.

DETAIL DESCRIPTION OF THE INVENTION

The present invention provides a composition of biodegradable gear oil, which comprises, base stock from mono-esters of non-edible vegetable oils in the range of 95.7 to 99.12 weight percent of the formulated oil.

There is scarcity of edible oil in India. So, it is not advisable to use edible oil for industrial purposes. Non-edible vegetable oil, which are found in abundance in India are, (1) Neem—*Mellia Azadirachta* in the family Meliaceae, popularly known as baypay, nambu, nim, tamaka, azadirac, limba, nimb, bevu, betain, veppu, kadukhajur, nimo, bakam, nib, margosa, nimmi, azulundi, etc., (2) Karanja—*Pongamia glabra* in the family Leguminaceae, popularly known as karanja, poonga, Indian beach, pungu, honge, punnu, pongam, koronjo-kanga, dalkaramcha, papri, karchaw, etc., (3) Ricebran—*Oryza sativa* in the family Graminaceae, also known as nivara, dhan, o-montana, o-setegera, o-latifolia, paddy, chawal, etc., (4) Mahua—*Madhuca Indica* & *Madhuca Longifolia*, popularly known as illipe, mee, madhuka, moha, mahua, mohua, mowra, mowrah, bassia, myitzu-thaka-natpau, ippe, yappa, mahuda, hippe, ponnam, maul, butter tree, (5) Castor—*Ricinus communis* in the family Euphorbiaceae (spurge), popularly known as palma Christi, ricin, krapata, djarak, reer, arand, arandi, etc., (6) Linseed—Flax oil plant *Linium usitatissimum* (Linacae), popularly known as linsed, flax, lint, alsi, etc., (7) Other similar vegetable oil or their mixture. The fatty acids in mono-esters are from at least one of these triglycerides. The typical physico-chemical characteristics and unsaturation characteristics are given below in Table 1 & 2. The base stock has viscosity, cst, between 50-82 at 40° C. and flash point between 200-240° C. (Cleveland Open Cup).

TABLE 1

PHYSICO-CHEMICAL CHARACTERISTICS OF VEGETABLE OILS

| Characteristics | Castor Oil | Linseed Oil | Mahua oil | Rice Bran Oil | Karanja Oil | Neem Oil |
|---|---|---|---|---|---|---|
| Kinematic Viscosity, cSt 40° C. | 252.0 | 25.15 | 48.55 | 23.75 | 43.42 | 68.04 |
| 100° C. | 19.0 | 6.74 | 9.18 | 6.06 | 8.35 | 10.15 |
| Viscosity Index | 90 | 248 | 174 | 222 | 172 | 134 |
| Iodine Value | 83 | 153 | 62 | 102 | 78 | 66 |
| Saponification Value mg KOH/g | 178 | 172.5 | 191 | 183 | 179 | 166 |
| Acid Value mg KOH/g | <4 | 3.4 | 39 | 85 | 22 | 23 |
| Pour Point ° C. | −10 | <−15 | +13 | −3 | −9 | +9 |

TABLE 2

FATTY ACID COMPOSITION OF VEGETABLE OILS

| Characteristics | Castor Oil | Linseed Oil | Mahua oil | Rice Bran Oil | Karanja Oil | Neem Oil |
|---|---|---|---|---|---|---|
| Saturated Acids | | | | | | |
| C12 | — | — | — | — | 1.6 | — |
| C14 | — | — | — | 0.4 | 7.9 | — |
| C16 | — | 6.4 | 24.2 | 17.0 | 4.0 | 14.0 |
| C18 | 0.3 | 4.5 | 24.6 | 2.7 | 2.0 | 19.0 |
| Unsaturated Acids | | | | | | |
| C18:1 | 8.2 | 21.0 | 39.8 | 45.5 | 62.0 | 49.0 |
| C18:2 | 3.6 | 17.4 | 13.7 | 27.7 | 12.0 | 9.5 |
| C18:3 | — | 50.6 | — | — | 5.0 | — |
| Ricinoleic | 87.6 | — | — | — | — | — |
| Erucic | — | — | — | — | — | — |

Non edible Vegetable seed oil is a long chain fatty acid (C18) tri-ester of glycerol possesses most of the desirable lubricant properties. It contains unsaturated acids such as

| | | |
|---|---|---|
| H2C-OOR[1] | R is CH3(CH2)7CH═CH(CH2)7COOH | |
| L | or, CH3(CH2)4CH═CH(CH2)7COOH | R'COOR" |
| HC-OOR[2] | or, CH3(CH2CH═CH)3(CH2)7COOH | |
| 1 | or, CH3(CH2)5CH(OH)(CH2)10COOH | |
| H2C-OOR[3] | | |
| Tri-ester | Fatty acid | mono-ester |

oleic (C 18:1) (carbon atom: un-saturation) as a major component. Some of the carboxylic acids and/or esters are derived from naturally occurring materials and therefore contain a mixture of compounds the major component of which is the oleic compounds. The alkaloids in vegetable oil which are responsible for toxicity or medicinal properties will be eliminated during processing of oil. The non-edible vegetable oil triglyceride fatty acid; such as C18:1, C18:2, C18:3, wherein the mono-unsaturation character is from about 50 to about 70 weight percent were taken.

Low thermo-oxidative stability of vegetable oils was improved by suitable chemical modification and additives. Vegetable oils (tri-ester) converted into mono-ester to gain desired thermo-oxidative stability. The stability can be further improved by partial hydrogenation, epoxidization or alkylation with aromatics. Per acetic acid was used for epoxidation. Excessive hydrogenation or saturation will reduce the cold temperature flow properties of the oil that's why partial hydrogenation or epoxidation were introduced.

The esters or fatty acids were hydrogenated or epoxidized up to iodine value<5. Then the esters were alkylated by Friedel Krafts reaction condition, where aryl group is from benzene, toluene, xylene, cumene, tetralin, or mixture thereof preferably toluene and xylene due to their low cost. More substituted benzenes are comparatively less toxic than benzenes. For alkylation various type of fatty acid ester may be used such as simple fatty acid or partial hydrogenated fatty acid or epoxidized fatty acid or hydrogenated and epoxidized fatty acid or mixture thereof. The chemical modification conditions were optimized and the desired thero-oxidative stability of the end product were achieved under IP 48 method (less than 1% increase in acid number). In place of synthesizing these esters, it can be acquired from the market also.

In the present invention, the mono-esters are from vegetable oil fatty acid prepared by trans-esterification. Higher branched primary alcohol C6 to C16 preferably C7 to C12 primary alcohol such as iso-hexanol, iso-heptanol, iso-octanol, 2-Methylheptanol, 2,2-Dimethylhexanol, 2-Methyl-3-ethylpentanol, 2,2,3-Trimethylpentanol, 2,2,3,3-Tetramethylbutanol 2ethyl-1-hexanol, iso-nonenol, 2-methyloctanol, 2,2-dimethylheptanol, 4-ethylheptanol, 2,2,3-trimethylhexanol, 2-methyl-4-ethylhexanol, 3,3-diethylpentanol, iso-decanol, iso-dodecanol, etc. preferably iso-heptanol, iso-octanol, 2-Methylheptanol, 2,2-Dimethylhexanol, 2-Methyl-3-ethylpentanol, 2,2,3-Trimethylpentanol, 2ethyl-1-hexanol, 3,3-diethylpentanol, iso-nonenol, or mixture thereof was taken for trans-esterification.

The synthesis of partially hydrogenated epoxidized toluene alkylated ethyl hexyl ester of vegetable oil fatty acid from seed oil: The rice bran oil (1 Kg) was dissolved in 4 lit heptane and kept at 15° C. for 6 hrs. Filtered to remove gummy material and solvent Was distilled off to get de-gummed oil. This oil is partially hydrogenated in a high pressure reactor having hydrogen at 200 psi, 130° C. and in presence of 4% Raney Nickel as catalyst until Iodine value of <5 was obtained. 400 gm of ethyl hexanol, 400 gm of partially hydrogenated rice bran oil and 4 gm of sodium hydroxide powder were added in a reactor. The reaction mixture was refluxed at 180° C. for 30 hours. The product was washed by water to remove sodium hydroxide and glycerol. Excess ethyl hexanol was removed by distillation under vacuum at 10 mm. 400 gm of partially hydrogenated rice bran mono-ester is treated with 134 gm of per acetic acid. Per acetic acid is added drop wise to rice bran oil fatty acid between 20-30° C. The addition is completed in 16 hours. The product is extracted in Diethyl ether and washed repeatedly with water to remove acetic acid and ether was distilled-off. The remaining semi solid epoxidized rice bran ester is washed with hot water to pH 5.5-7.0. 200 gm of partially hydrogenated epoxidized mono-ester from ricebran oil was dissolved in 500 gm of toluene and cooled to 20° C. 100 gm of anhydrous $FeCl_3$ was slowly added over a period of one hour. The temperature was allowed to rise to 40° C. and reaction mixture was maintained at that temperature for 15 hours with constant stirring. The contents were poured into the water and 10% hydrochloric acid. After 12 hours, the upper layer was washed repeatedly with water to remove acidity. The entrained water in the upper layer was removed by Dean & stark trap. The toluene was distilled off and last traces removed under vacuum.

The above ester may have any type of fatty acid ester such as simple Fatty acid or partial hydrogenated fatty acid or epoxidized fatty acid or hydrogenated and epoxidized fatty acid or mixture thereof. Alkylation can be done with the various aromatic such as benzene or toluene or xylene or tetralin or cumene or mixture thereof. In place of synthesizing these esters, it can be acquired from the market also.

The gear oil formulation contains various additives also. While selecting the additive the toxicity, synergism with other selected additives and effect of indivisual additive on the base oil were considered. First by using screening test, few compounds and their dosage were selected in various permutation and combinations. Then formulated gear oil was tested for their different properties. While selecting the antioxidant the toxicity, synergism with other selected additives and effect of indivisual antioxidant on the base oil were considered. First by using rotary bomb oxidation test (ASTM D 2272) on doped base-oil few compounds and their dosage were selected in various permutation and combinations then finally tested by IP 48 method. Similarly, the extreme pressure additive is selected by using test on high frequency reciprocal rig HFRR (ISO 12156), The anti-foaming agent is selected by using foaming test (ASTM D 892), The pour point depressants is selected by using pour point test (ASTM D 92), the anti-corrosion additive is selected by using copper strip corrosion test (ASTM D 130) and the detergent-dispersant is selected by using detergency test (Fed test method 791-3464). The use of commercial branded additive pack will also serve the purpose.

The anti-oxidant is selected from 2,4,6-tri-tert-butylphenol, 2,6-di-tert-butyl-4-n-butylphenol, 2,6-di-t-butyl-4-methylphenol, dinaphthylamines, 4-methyl-2,6-di-(t-butyl) phenol, propyl gallate, alkylated 5-amino tetrazole [where alkyl chain may be C8, C9, C10, C11, C12, C14, C16, C18, mixture thereof and attached via N-alkylation], di-ter. Butyl p-amino phenol, α-tocopherol, butylated hydroxy anisole or a mixture thereof preferably 2,6-di-t-butyl-4-methylphenol, propyl gallate, alkylated 5-amino tetrazole, butylated hydroxy anisole, α-tocopherol or a mixture thereof in the range, of 0.06 to 0.5 weight percent of the formulated gear oil.

In yet another embodiment of the present invention, the extreme pressure additive is selected from sulfurized neem oil, sulfurized mahua oil, dibenzyl disulfide, suphurized hydrogenated cardanol, thiophosphoro lauryl oleate, molybdenum salt of thiophosphoro lauryl oleate, zinc dialkyl dithio phosphate, dibenzyl diselenate, selenophosphoro lauryl oleate, selenophosphoro hydrogenated cardanol, molybdenum thiophosphoro hydrogenated cardanol, or a mixture thereof preferably from sulfurized neem oil, dibenzyl disulfide, molybdenum salt of thiophosphoro lauryl oleate, molybdenum thiophosphoro hydrogenated cardanol, mixture thereof in the range of 0.6 to 1.0 weight percent of formulated gear oil, Cardanol is a natural occurring alkyl phenol found in cashew nut shell extract having formula 3-8, 11, Pentadecyl Phenol.

The anti-foaming agent is selected from silicone oil, polyvinyl alcohol, polyethers, or a mixture thereof in the range of 0.01 to 1.0 weight % of formulated gear oil.

The pour point depressants is selected from silicone oil, diethylhexyl adipate, polymethacrylate, polyvinylacrylate, or a mixture thereof in the range of 0.01 to 1.0 weight percent of formulated gear oil. Majority of these compounds act as anti-foaming agent cum pour point depressants.

The anti-corrosion additive is selected from octyl 1H benzotriazole, ditertiary butylated 1H-Benzotriazole, propyl gallate, polyoxyalkylene polyols, octadecyl amines, nonyl phenol ethoxylates, calcium phenolates of hydrogenated cardanol, magnesium alkyl benzene sulfonates, or a mixture thereof in the range of 0.1 to 0.3 weight percent of formulated gear oil.

The detergent-dispersant is selected from amino alkyl benzene sulfonate, calcium alkyl benzene sulfonate, sodium alkyl benzene sulfonate, propylene tetramer succinimide of pentaethylene hexamine, octyl phosphonates, or a mixture thereof in the range of 0.1 to 0.5 weight percent of formulated gear oil.

The present invention, the compositions are significantly biodegradable (Test as per ASTM D 5864-99), exhibit excellent miscibility with mineral and synthetic oil in all proportions. The main advantages of the present invention are, reduces use of petroleum, beneficial to farmers, and safer to handle due to higher flash point of 200-240° C. The present lubricant would be particularly suited for GL 4 grade, general purpose automotive and industrial gear oil.

The following examples are given by way of illustration and therefore should not be constructed to limit the scope of the invention.

Example 1

Seed Oil to Partially Hydrogenated Epoxidized Toluene Alkylated Ethyl Hexyl Ester of Vegetable Oil Fatty Acid The rice bran oil (1 Kg) was dissolved in 4 lit heptane and kept at 15° C. for 6 hrs. Filtered to remove gummy material and solvent was distilled off to get de-gummed oil. This oil is partially hydrogenated in a high pressure reactor having hydrogen at 200 psi, 130° C. and in presence of 4% Raney Nickel as catalyst until Iodine value of <5 was obtained. 400 gm of ethyl hexanol, 400 gm of partially hydrogenated rice bran oil and 4 gm of sodium hydroxide powder were added in a reactor. The reaction mixture was refluxed at 180° C. for 30 hours. The product was washed by water to remove sodium hydroxide and glycerol. Excess ethyl hexanol was removed by distillation under vacuum at 10 mm. 400 gm of partially hydrogenated rice bran mono-ester is treated with 134 gm of per acetic acid. Per acetic acid is added drop wise to rice bran oil fatty acid between 20-30° C. The addition is completed in 16 hours. The product is extracted in Diethyl ether and washed repeatedly with water to remove acetic acid and ether was distilled-off. The remaining semi solid epoxidized rice bran ester is washed with hot water to pH 5.5-7.0. 200 gm of partially hydrogenated epoxidized mono-ester from ricebran oil was dissolved in 500 gm of toluene and cooled to 20° C. 100 gm of anhydrous $FeCl_3$ was slowly added over a period of one hour. The temperature was allowed to rise to 40° C. and reaction mixture was maintained at that temperature for 15 hours with constant stirring. The contents were poured into the water and 10% hydrochloric acid. After 12 hours, the upper layer was washed repeatedly with water to remove acidity. The entrained water in the upper layer was removed by Dean & stark trap. The toluene was distilled off and last traces removed under vacuum.

Note:

- The above ester may have any type of fatty acid ester such as simple Fatty acid or partial hydrogenated fatty acid or epoxidized fatty acid or hydrogenated and epoxidized fatty acid or mixture thereof.
- Alkylation can be done with the various aromatic such as benzene or toluene or xylene or tetralin or cumene or mixture thereof.
- In place of synthesizing these esters, it can be acquired from the market also.

Example 2

Purification of Alkylated Epoxy Ester

Simple Toluene derivatives of epoxy ester of neem oil fatty acid and ethyl-hexanol [major portion is of 2Ethyl-1-hexyl, (10-epoxy, 8-toluene) 9, octadecenoic ester formula—$C_8H_{17}$(>O)CH═CH(—$C_6H_5CH_3$) $C_7H_{14}COOCHCH_2(C_2H_5)C_5H_{10}$] was purified by dissolving it in a mixed solvent containing heptane and ethanol. The mixture of oil and solvent was cooled to 12-15° C. and the temperature maintained for 5 to 7 h. The upper layer containing oil and solvent was passed through Multani clay coulnm. Solvent was recovered to get purified oil.

Example 3

Purification of Alkylated Epoxy Ester

Xylene alkylated Epoxy ester of karanja oil fatty acid and ethyl hexanol [major portion is of 2Ethyl-1-hexyl, (10-epoxy, 8-xylene) 9,octadecenoic ester formula—$C_8H_{17}$(>O)CH═CH($C_6H_6C_2H_6$) $C_7H_{14}COOCHCH_2(C_2H_5)C_5H_{10}$] was purified by dissolving it in a mixed solvent containing heptane and ethanol. The mixture of oil and solvent was cooled to 12-15° C. and the temperature maintained for 5 to 7 h. The upper layer containing oil and solvent was passed through Indian Multani clay column. Solvent was recovered to get purified oil.

Example 4

Purification of Alkyl Ester

Alkyl (Tetralin substituted) ester of Mahua oil fatty acid and ethyl hexanol [major portion is of 2Ethyl-1-hexyl,(10-tetralin) 9, octadecenoic ester formula—$C_8H_{17}$(—$C_{10}H_{12}$)CH═CH$C_7H_{14}COOCHCH_2(C_2H_5)C_5H_{10}$] was purified by dissolving it in a mixed solvent containing heptane and ethanol. The mixture of oil and solvent was cooled to 12-15° C. and the temperature maintained for 5 to 7 h. The upper layer containing oil and solvent was passed through Indian Multani clay column. Solvent was recovered to get purified oil.

Example 5

Purification of Partially Hydrogenated Alkyl Ester

Toluene alkylated simple ester of ricebran oil partially hydrogenated fatty acid and ethyl hexanol [major portion is of 2Ethyl-1-hexyl, (10-toluene) 9, octadecenoic ester formula—$C_8H_{17}$(—$C_6H_5CH_3$)CH═CH$C_7H_{14}COOCHCH_2(C_2H_5)C_5H_{10}$] was purified by known method by dissolving it in a mixed solvent containing heptane and ethanol. The mixture of oil and solvent was cooled to 12-15° C. and the temperature maintained for 5 to 7 h. The upper layer containing oil and solvent was passed through clay column. Solvent was recovered to get purified oil.

Example 6

Preparation of Base Stock (A)

Purified Toluene alkylated epoxy ethyl hexyl trans-ester of neem oil fatty acid 100% (w/w). The fluid has Kinematic Viscosity at 40° C.—54 cst, Viscosity index—204, Oxidation stability—0.89% increase in K. Vis (IP 48/97), Flash point—228° C., Pour point—(−)13° C., Acid number—<0.5 mg KOH, Copper strip corrosion (3 hrs at 100° C.)—1 A, Saponification Value—152 mg KOH.

Example 7

Preparation of Base Stock (B)

50% (w/w) of purified alkyl (toluene substituted) ethyl hexyl trans-ester of mahua oil fatty acid and 50% (w/w) of purified Toluene alkylated epoxy ethyl hexyl trans-ester of neem oil fatty acid. The fluid has Kinematic Viscosity at 40° C.—52 cst, Viscosity index—250, Oxidation stability—0.89% increase in K. Vis (IP 48/97), Flash point—208° C., Pour point—(−)12° C., Acid number—<0.5 mg KOH, Copper strip corrosion (3 hrs at 100° C.)—1 A, Sap. Value—162 mg KOH.

Example 8

Preparation of Base Stock (C)

45% (w/w) of purified alkyl (toluene substituted) ethyl hexyl trans-ester of mahua oil fatty acid and weight 55% (w/w) of purified xylene alkylated epoxy ethyl hexyl trans-ester of karanja oil fatty acid. The fluid has Kinematic Viscosity at 40° C.—84.02 cst, Viscosity index—265, Oxidation stability—0.89% increase in K. Vis (IP 48/97), Flash point—218° C., Pour point—(−)10° C., Acid number—<0.5 mg KOH, Copper strip corrosion (3 hrs at 100° C.)—1 A, Sap. Value—145 mg KOH.

Example 9

Preparation of Base Stock (D)

100% (w/w) purified toluene alkylated ethyl hexyl ester of partially hydrogenated ricebran oil fatty acid. The fluid has Kinematic Viscosity at 40° C.—81.4 cst, Viscosity index—241, Oxidation stability—0.89% increase in K. Vis (IP 48/97), Flash point—225° C., Pour point—(−)10° C., Acid number—<0.5 mg KOH, Copper strip corrosion (3 hrs at 100° C.)—1 A, Saponification Value—180 mg KOH.

Example 10

Preparation of Gear Oil from Base Stock

The base stock (A) was blended in 98.91% (w/w) with additive octyl 5 amino tetrazole in 0.02% (w/w) and α-tocopherol in 0.05% (w/w) as anti-oxidant, dibenzyl disulphide in 0.2% (w/w), sulfurized neem oil in 0.2% (w/w) and molybdenum salt of thiophosphoro lauryl oleate in 0.3% (W/W) as extreme pressure additive, pentaethylene hexamine dodecyl succinimide as detergent-dispersant in 0.1% (w/w), Silicone polymer oil as antifoaming agent in 0.01% (w/w), polyvinylacrylate as pour point depressant in 0.01% (w/w) and magnesium Alkyl Benzene sulfonate as corrosion inhibitors having base number 500 in 0.2% (w/w) concentration. The doping was done by known method at 60° C. with stirring for 2 hours. The fluid has Kinematic Viscosity at 40° C.—55 cst, Viscosity index—205, Oxidation stability—0.88% increase in K. Vis (IP 48/97), Flash point—226° C., Pour point—(−)14° C., Acid number-nil, Ash sulfated %<0.5, Emulsion test—40-39-1(20), Rust test-nil.

Example 11

Preparation of Gear Oil from Base Stock

The base stock (B) was blended in 98.53% (w/w) with additive propyl gallate in 0.02% (w/w) & 2,6-di-t-butyl-4-methyl phenol in 0.05% (w/w) as anti-oxidant, dibenzyl diselenate as Extreme Pressure additive in 0.2% (w/w), sulfurized mahua oil as second extreme pressure additives in 0.2% (w/w), molybdenum thiophosphoro hydrogenated cardanol as third extreme pressure additives in 0.2% (w/w), octyl phosphonate as detergent-dispersant in 0.2% (w/w), polymethacrylate as pour point depressant in 0.5% (w/w), poly vinyl alcohol as antifoaming agent in 0.05% (w/w) and alkyl benzotriazole as corrosion inhibitors in 0.05% (w/w) concentration. The doping was done by known method at 60° C. with stirring for 2 hours. The fluid has Kinematic Viscosity at 40° C.—53 cst, Viscosity index—252, Oxidation stability—0.75% increase in K. Vis (IP 48/97), Flash point—210° C., Pour point—(−)13° C., Acid number-nil, Ash sulfated %<0.5, Emulsion test—40-39-1(20), Rust test-nil.

Example 12

Preparation of Gear Oil from Base Stock

The base stock (C) was blended in 99.74% (w/w) with additive alkylated 5-amino tetrazole in 0.015% (w/w) & di-t-butyl p-amino phenol in 0.01% (w/w) as anti-oxidant, Molybdenum thiophosphoro hydrogenated cardanol in 0.02% (w/w) & sulfurized hydrogenated cardanol in 0.02% (w/w) as Extreme Pressure additives, sodium alkyl benzene sulfonate as detergent-dispersant in 0.05% (w/w), polyethers as antifoaming agent cum pour point depressant in 0.1% (w/w) and calcium phenolates of hydrogenated cardanol as corrosion inhibitors in 0.045% (w/w) concentration. The doping was done at 60° C. with stirring for 2 hours. The fluid has Kinematic Viscosity at 40° C.—85 cst, Viscosity index—266, Oxidation stability*—0.89% increase in K. Vis (IP 48/97), Flash point—215° C., Pour point—(−)11° C., Acid number-nil, Ash sulfated %<0.5, Emulsion test—40-39-1(20), Rust test-nil.

Example 13

Preparation of Gear Oil from Base Stock

The base stock (D) was blended in 99.74% (w/w) with additive butylated hydroxy anisole in 0.025% (w/w) & dinaphthylamine in 0.02% (w/w) as anti-oxidant, zinc dialkyl dithio phosphate in 0.02% (w/w) & molybdenum thiophosphoro lauryl oleate in 0.02% (w/w) & selenophosphoro lauryl oleate in 0.01% (w/w) as Extreme Pressure additive, calcium alkyl benzene sulfonate as detergent-dispersant in 0.02% (w/w), diethylhexyl adipate as antifoaming agent cum pour point depressant in 0.1% (w/w) and nonyl phenol ethoxylates as corrosion inhibitors in 0.045% (w/w) concentration. The doping was done by known method at 60° C. with stirring for 2 hours. The fluid has Kinematic Viscosity at 40° C.—82 cst, Viscosity index—242, Oxidation stability—0.90% increase in K. Vis (IP 48/97), Flash point—223° C., Pour point—(−)11° C., Acid number—nil, Ash sulfated %<0.5, Emulsion test—40-39-1(20), Rust test-nil.

Example 14

Characterization and Evaluation of Gear Oil

The formulations were analyzed and evaluated as per ASTM or BIS methods such as ASTM D445/BIS-14234, P25/56—K. Viscosity & Viscosity index, ASTM D 92/BIS-P21/69—Flash point, ASTM D130/BIS-P15—Copper corrosion, ASTM D97/BIS-P10—Pour point, ASTM D874/BIS-P4—Ash sulfated, ASTM D 664/BIS-P1—TAN, ASTM D4377/BIS-P40—Water content, IP 280, 306, 307—Oxidation Test, ASTM D3711—Coking test.

Example 15

TYPICAL PERFORMANCE OF FORMULATED GEAR OIL

| Lube | Lubricity F. Coeff | Lubricity WSD | RBOT Minuts | Copper Strip corrosion test | Foam test ASTM D130 | Bio Degradability % | Panel coking tast −20 mg max |
|---|---|---|---|---|---|---|---|
| A | 0.111 | 0.302 | 200 | 1A | Pass | <98 | Pass |
| B | 0.105 | 0.303 | 180 | 1A | Pass | <98 | Pass |
| C | 0.114 | 0.303 | 150 | 1A | Pass | <98 | Pass |
| D | 0.113 | 0.307 | 150 | 1A | Pass | <98 | Pass |

ADVANTAGES

1. The base oils of the compositions are completely biodegradable and totally from renewable source i.e. non-edible vegetable oil. (This is innovative and non-obvious development).
2. The present lubricant would be particularly suited for GL 4 grade, general purpose automotive and industrial gear oil.
3. Ecofriendly from a renewable source.
4. Exhibit excellent miscibility with mineral and synthetic oil in all proportions. Economical than synthetic oil based gear-oil.
5. Reduces use of petroleum,
6. Beneficial to farmers,
7. Safer to handle due to higher flash point of 200-240° C.

The main advantages of the present invention are that the composition of the gear oil is fairly biodegradable and eco-friendly from non-edible vegetable oils and provides better or equivalent performance as mineral oil based gear oils. The present invention provides gear oil which is superior in performance, particularly in viscosity index, flash point and toxicity, as compared below.

Comparison of properties of gear oil

| SN. | Properties | U.S. Pat. No. 6,872,693 Mineral oil | U.S. Pat. No. 6,649,574 synthetic. Oil | Our claim Veg. oil | Remarks |
|---|---|---|---|---|---|
| 1 | Ki.Viscosity at 100° C., cst | 6-8 | 20-50 | 13.5 | Better than MO |
| 2 | Flash Point, ° C. | 204 | 310 | 210 | Better than MO |
| 3 | Pour point, ° C. | — | −20 | −20 | Better than MO |
| 4 | Viscosity Index | 120 | — | 252 | Better |
| 5 | Biodegradability % | 20-40 | 95 | 98 | Better |
| 6 | Toxic (Poly aromatics) | Yes | No | No | Better than MO |

We claim:

1. A composition of biodegradable gear oil comprising:

i. a base oil stock containing a monoester of a non-edible vegetable oil fatty acid or mixture thereof, in the range of 95.5-99.5% by weight, wherein the monoester of non-edible vegetable oil fatty acid is selected from the group consisting of toluene derivative of epoxy ester of neem oil fatty acid, xylene alkylated epoxy ester of rice bran oil, toluene ester of mahua oil, toluene ester of rice bran oil, cumene or tetralin ester of non-edible vegetable oil and a mixture thereof, and ii. an additive pack in the range of 0.5-4.5% by weight, and wherein said additive pack comprises:

a. at least one anti-oxidant selected from the group consisting of phenol, amines, gallate, tetrazole, and an anisole type of compound, in the range of 6.5-12.0% by weight, b. at least one extreme pressure additive selected from the group consisting of sulfide, selenide, phosphosulfide, and phosphoselenide in the range of 68.0-23.5% by weight, c. at least one pour point depressant cum anti-foaming agent selected from the group consisting of polymeric long chain acrylate, alcohol, ester, ether, and adipate type compounds in the range of 2.0-46.5% by weight, d. at least one corrosion inhibitor selected from the group consisting of triazole, gallate, polyols, amines, phenols and sulfonates in the range of 11.0-7.0% by weight and e. at least one detergent-dispersant selected from the group consisting of sulfonate, succinimides, and phosphonates in the range of 11.0-12.0% by weight.

2. The composition of biodegradable gear oil as claimed in claim 1, wherein said composition has the following characteristics:

I. Kinematic viscosity at 40° C. is in the range of 50-82 cst,

II. Viscosity index is between 200-270,

III. Oxidation stability—Pass (IP 48/97) (max 1% increase in viscosity & TAN)

IV. Rotary bomb oxidation test at 95° C. is between 150-200 min.,

V. Flash point is between 210-240° C.,

VI. Pour point is between (−)9 to (−)25° C.,

VII. Ash sulfated % is <0.05,

VIII. Copper Strip corrosion test—1 A,

IX. Foam test ASTM D130—Pass,

X. Emulsion test—less than 40-39-1(20);

XI. Lubricity-Friction coefficient—0.105-0.115,

XII. Lubricity-wear scar diameter (mm)—0.303-0.305,

XIII. Panel cocking test (deposit, 20 mg max)—Pass and

XIV. Biodegradability is between 90-100%.

3. The composition as claimed in claim 1, wherein the monoester of non-edible vegetable oil fatty acid base stock has viscosity, cst, ranging between 50-82, at 40° C.

4. The composition as claimed in claim 1, wherein the anti-oxidant is selected from the group consisting of 2,4,6-tri-tert-butylphenol, 2,6-di-tert-butyl-4-n-butylphenol, 2,6-di-t-butyl-4-methylphenol, dinaphthyl amines, 4-methyl-2,6-di-(t-butyl)phenol, propyl gallate, alkylated 5-amino tetrazole, di-t-butyl-p-amino phenol, α-tocopherol, butylated hydroxy anisole and a mixture thereof.

5. The composition as claimed in claim 1, wherein the extreme pressure additive is selected from the group consisting of sulfurized neem oil, sulfurized mahua oil, dibenzyl disulfide, sulfurized hydrogenated cardanol, thiophosphoro lauryl oleate, molybdenum salt of thiophosphoro lauryl oleate, zinc dialkyl dithio phosphate, dibenzyl diselenate, selenophosphoro lauryl oleate, selenophosphoro hydrogenated cardanol, molybdenum thiophosphoro hydrogenated cardanol and a mixture thereof.

6. The composition as claimed in claim 1, wherein the pour point depressant cum anti-foaming agent is selected from the group consisting of silicone oil, polyvinyl alcohol, polyethers, diethylhexyl adipate, polymethacrylate, polyvinylacrylate and a mixture thereof.

7. The composition as claimed in claim 1, wherein the corrosion inhibitor additive is selected from the group consisting of octyl 1H benzotriazole, ditertiary butylated 1H-Benzotriazole, propyl gallate, polyoxyalkylene polyols, octadecyl amines, nonyl phenol ethoxylates, calcium phenolates of hydrogenated cardanol, magnesium alkyl benzene sulfonates and a mixture thereof.

8. The composition as claimed in claim 1, wherein the detergent-dispersant is selected from the group consisting of amino alkyl benzene sulfonate, calcium alkyl benzene sulfonate, sodium alkyl benzene sulfonate, propylene tetramer succinimide of pentaethylene hexamine, octyl phosphonates and a mixture thereof.

9. The composition as claimed in claim 1, wherein said composition is useful for GL 4 grade, general purpose automotive and industrial gear oil.

* * * * *

UNITED STATES PATENT AND TRADEMARK OFFICE

CERTIFICATE OF CORRECTION

PATENT NO. : 8,557,754 B2
APPLICATION NO. : 12/922874
DATED : October 15, 2013
INVENTOR(S) : Arun Kumar Singh et al.

It is certified that error appears in the above-identified patent and that said Letters Patent is hereby corrected as shown below:

Title Page, in the Assignee Item (73), "Counsel" should read --Council--.

Signed and Sealed this
Fourth Day of February, 2014

Michelle K. Lee

Michelle K. Lee
*Deputy Director of the United States Patent and Trademark Office*